United States Patent [19]

Cornell

[11] Patent Number: 4,460,532

[45] Date of Patent: Jul. 17, 1984

[54] METHOD FOR MAKING MOLDINGS USING A FIXED SHAPING DIE

[76] Inventor: Richard R. Cornell, 334 W. State St., Newcomerstown, Ohio 43832

[21] Appl. No.: 378,596

[22] Filed: May 17, 1982

[51] Int. Cl.[3] ..... B28B 7/14; B27M 3/00

[52] U.S. Cl. ..... 264/163; 144/12; 144/30; 264/138; 264/145; 264/177 R; 425/298; 425/461

[58] Field of Search ..... 144/12, 30, 2 A, 10, 144/20, 28, 120, 174, 355, 357, 360, 361, 366, 375; 425/298, 461; 264/163, 145, 138, 139, 177 R, 280

[56] References Cited

U.S. PATENT DOCUMENTS

| | | | |
|---|---|---|---|
| 117,083 | 7/1871 | Lamb | 144/12 |
| 155,853 | 10/1874 | Brandon | 144/120 |
| 187,914 | 2/1877 | Sawyer | 144/120 |
| 502,656 | 8/1893 | Campbell | 144/12 |
| 802,184 | 10/1905 | Farnum | 144/12 |
| 882,978 | 3/1908 | Temps | 144/369 |
| 2,596,365 | 5/1952 | Bresnaham | 144/41 |
| 2,612,193 | 9/1952 | Springer | 144/12 |
| 2,681,086 | 6/1954 | Degen | 144/12 |
| 3,157,093 | 11/1964 | Shaw et al. | 29/557 |
| 3,783,917 | 1/1974 | Mochizuki | 144/175 |
| 4,371,020 | 2/1983 | Barnes et al. | 144/366 |

FOREIGN PATENT DOCUMENTS

| | | | |
|---|---|---|---|
| 453516 | 12/1949 | Italy | 144/12 |

*Primary Examiner*—Donald E. Czaja
*Assistant Examiner*—James C. Housel
*Attorney, Agent, or Firm*—Renner, Kenner, Greive & Bobak

[57] ABSTRACT

The present invention is directed to a unique die (11, 111) that can be employed in apparatus (10) for shaping a workpiece (14, 114) according to the method of driving the workpiece at relatively high speeds through the die (11, 111) which remains fixed. The die has a throat (40, 140) which extends longitudinally through a body portion (35, 135) and opens through a crenelated mouth (45, 145). The mouth is provided with opposed noses (46, 48, 146, 147 and 148) which delineate the distal extent of the mouth with respect to the body portion of the die. Cutting edges (50, 51, 54, 55, 150, 151, 154, 155, 173 and 174) extend rearwardly from the noses, with each pair of adjacent cutting edges joining to define a crotch (59, 60, 159, 178 and 179). The resulting plurality of crotches delineate the longitudinally proximal extent of the mouth with respect to the body portion of the die. Each cutting edges is disposed so that the entering angle $\theta$ falls within the range of from 25° to 50°.

3 Claims, 8 Drawing Figures

FIG. 1
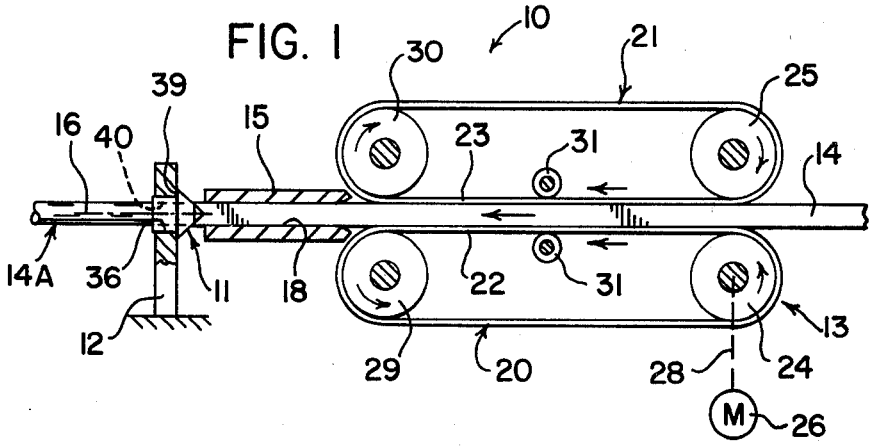
FIG. 2
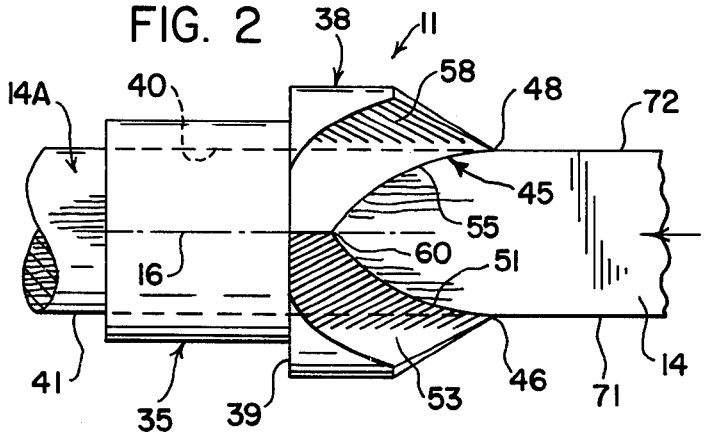
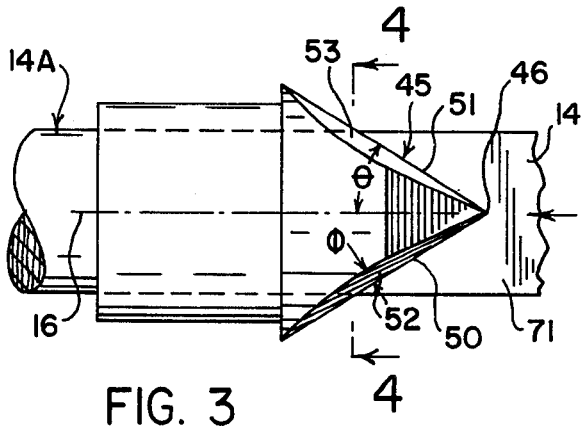
FIG. 3
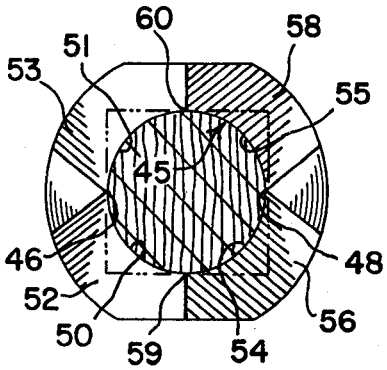
FIG. 4

METHOD FOR MAKING MOLDINGS USING A FIXED SHAPING DIE

TECHNICAL FIELD OF THE INVENTION

The present invention is generally directed to a method and apparatus for shaping fiberboard or the like. More particularly, the present invention is directed to the concept of driving a fiberboard, or comparable, workpiece past, or through, a non-rotatable, fixed shaping head. Specifically, the present invention is directed to the shaping of a fiberboard, or comparable, workpiece by driving the latter at relatively high speed past, or through, a fixed shaping die with the "grain" of the workpiece and the configuration of the shaping die being compatibly oriented.

BACKGROUND ART

Historically, some efforts were made to shape wood, plaster of Paris, and the like, by moving the workpieces past a series of fixed cutting blades, but over the years the concept of moving the workpieces past a cutting head that is rotated on an arbor at speeds in the range of 7000 to 12,000 r.p.m. developed as the preferred mode of shaping wood, and wood products. The historical approach of moving the item to be shaped past a series of fixed cutting blades is perhaps best exemplified by U.S. Pat. Nos. 155,853 and 187,914.

When the price of structural lumber began to soar, ways were found to utilize that wood which was of such poor quality that it could not be cut to provide lumber of an acceptable grade. Similarly, chips of wood remaining from certain lumber processing operations, and even the sawdust produced as the better trees were milled for quality lumber, was no longer wasted. Particleboard and fiberboard were the results, and both are now widely employed as a substitute for more expensive lumber.

Particleboard is extremely difficult to shape by any means, because the non-homogeneous nature of the board itself—consider the varied size of particles comprising the aggregate and their rather modest firmness as compared to the relatively hard resins employed as the matrix within which the particles are bonded—causes it to chip, even when very carefully fed past the sharpest rotating cutting head.

Fiberboard, on the other hand, has a more uniform consistency and is, therefore, capable of being much more readily shaped on a conventional shaper. Shaping of fiberboard, however, is quite deleterious to the blades themselves. This fact is best appreciated by understanding that the cellulosic fibers from which the fiberboard is made are bonded together by an adhesive which is much harder than the fibers themselves so that as the shaping blades cut into the fiberboard the adhesive effects an abrasive action against the knife edge of the shaper blades.

On every revolution of the shaper head each blade is subjected to this abrasive action during that portion of the arcuate path described by the cutting edge of the blade as it moves from the surface of the face being shaped outwardly to the surface of the workpiece. The high r.p.m. at which the shaper head rotates further compounds the extent of this abrasive action. The cost to change and/or sharpen blades as they dull by such usage virtually obviates the savings occasioned by substituting fiberboard for the more expensive lumber when a shaping operation is involved.

DISCLOSURE OF THE INVENTION

It is, therefore, a primary object of the present invention to provide a new, novel and unique method and apparatus that is eminently suitable for shaping workpieces of such materials as fiberboard or the like.

It is another object of the present invention to provide a method and apparatus for shaping, as above, by which the workpiece is driven past, or through, a fixed die.

It is a further object of the present invention to provide a method and apparatus, as above, by which the life of the cutting edge on the shaper die is extended by virtue of the fact that the cutting edge on the shaper die engages only the face of the surface being shaped.

It is yet another object of the present invention to provide a method and apparatus, as above, by which the rate at which shaping is effected is significantly increased, and in many situations more than doubled, with respect to the rate currently possible with prior art methods and apparatus.

These and other objects of the invention, as well as the advantages thereof over existing and prior art forms, which will be apparent in view of the following specification are accomplished by means hereinafter described and claimed.

In general, apparatus embodying the concept of the present invention shapes the workpiece by a method that entails forcing the workpiece through a unique die. When the workpiece has a grain, or is layered, like fiberboard, for example, the orientation of the layers, or grain, is noted, and the workpiece must be inserted into the die so that the initial contact between the die and the workpiece is transversely the layers, or grain, of the workpiece.

In order to accomplish the requisite orientation a throat extends longitudinally through the body of the die. The cross-sectional configuration of the throat conforms with the surface of the workpiece after it has been shaped, and the throat opens through a crenelated mouth. The crenelated mouth presents at least a pair of opposed noses which define the longitudinally distal extent of the mouth with respect to the body portion of the die. Cutting edges, each of which are defined by the intersection of the throat with the mouth, thus delineate the cross-sectional configuration to which the die shapes the workpiece. The cutting edges extend rearwardly from the noses with adjacent cutting edges intersecting to define a crotch. The plurality of crotches, in turn, define the longitudinally proximal extent of the mouth with respect to the body portion of the die.

The exact configuration of the crenelated mouth is determined by the configuration desired for the final shape of the workpiece—it being mandatory to assure that at least two opposed noses are located such that they will contact the workpiece transversely of the layers, and preferably along surfaces requiring minimal shaping. The cutting edges are disposed to extend rearwardly of the noses at an entering angle of preferably between 25° to 50° with the maximum material being removed by the shaping action of the die at the crotches, or along the cutting edges as they converge to form a crotch.

Two embodiments of a die embodying the concept of the present invention—one to shape a dowel rod and one to shape a more complicated molding—are shown by way of example in the accompanying drawings without attempting to show all of the various forms and modifications in which the invention might be embodied; the invention being measured by the appended claims and not by the details of the specification.

BRIEF DESCRIPTION OF THE DRAWINGS

FIG. 1 is a schematic side elevation of apparatus for shaping a workpiece in accordance with a method that incorporates the use of a novel and unique shaping die which embodies the concept of the present invention;

FIG. 2 is a top plan of an exemplary shaping die which embodies the concept of the present invention—said shaping die being depicted in the process of shaping a workpiece of generally rectangular cross-section into a cylindrical dowel rod;

FIG. 3 is a side elevation of the die and workpiece depicted in FIG. 2;

FIG. 4 is a cross-sectional view taken substantially on line 4—4 of FIG. 3;

PREFERRED MODE FOR CARRYING OUT THE INVENTION

Figure 5:
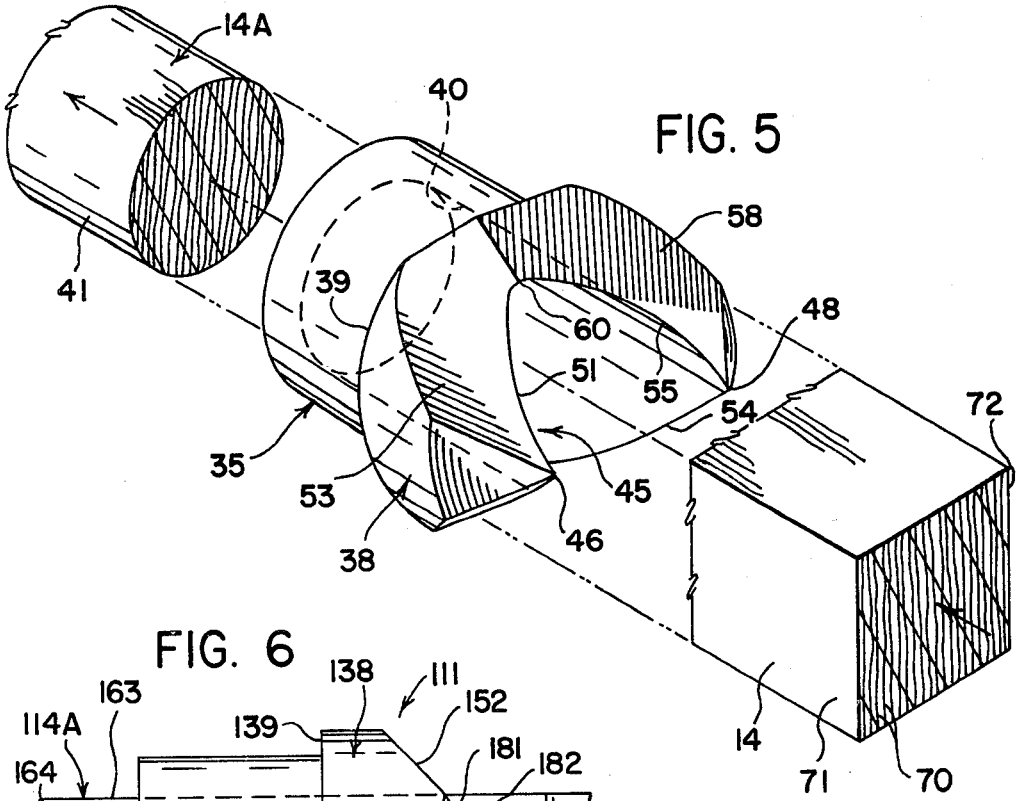
FIG. 5 is an enlarged frontal perspective of the die and workpiece depicted in FIGS. 2 through 4.

Apparatus for shaping a workpiece in conformity with the concept of the present invention is depicted schematically in FIG. 1 and identified generally by the numeral 10. In essence, the apparatus 10 employs a novel and unique die 11 rigidly supported from a stanchion 12. A traction feed mechanism 13 is aligned with the die 11 to force a workpiece 14 therethrough, and a guide 15 is positioned between the die 11 and the feed mechanism 13 to stabilize the disposition of the workpiece 14 with respect to the longitudinal axis 16 of the die 11 as the workpiece is driven by the feed mechanism into the die. Optimum results are obtained by positioning the guide 15 in relatively close proximity to the die 11. It should also be appreciated that the workpiece 14 must be stabilized as much as reasonably possible between the traction feed mechanism 13 and the guide 15 as between the die 11 and the guide. In fact, in developing the present apparatus most failures occurred as breaks in the workpiece between the traction feed mechanism 13 and the guide 15.

An acceptable, unsupported span of the workpiece between the traction feed mechanism 13 and the die 11 will vary, for example, as a result of the cross-sectional configuration and density of the workpiece being employed. Cross-sectional importance is perhaps more readily apparent, but density has been found to be a definite consideration. At an optimum density the maximum unsupported span may be employed, but at a lesser density the columnar strength of the workpiece may not be sufficient to transmit the forces applied by the traction feed mechanism 13 through the workpiece to the die 11. However, simply employing workpieces of increased density is not a satisfactory solution.

As the density of the workpiece increases, the resistance offered by the die 11 to the passage of the workpiece 14 therethrough may increase sufficiently to impose failure stresses on any excessively unsupported span of the workpiece between the time it leaves the traction feed mechanism and enters the die. Support can be improved, as desired or required, by selecting an appropriate configuration for the guide 15 and/or the particular traction feed mechanism 13.

In addition, it is highly desirable for the cross-sectional configuration of the passageway 18 through the guide 15 to conform to the cross-sectional configuration of the workpiece 14 being feed therethrough. The cross-sectional configuration of the workpiece should, if possible, also be selected to minimize the depth of the various cuts required to achieve the desired finished, or shaped, workpiece 14A. This not only minimizes the waste material removed by the die but can also minimize the forces required to drive the workpiece through the die and thereby increase the acceptable unsupported span of the workpiece between the traction feed mechanism 13 and the die 11.

The feed mechanism must be capable of driving the workpiece through the die with considerable force, and, for maximum efficiency, at as high a rate of speed as practical. One suitable arrangement for accomplishing this result is depicted schematically in FIG. 1. In that arrangement a pair of endless belts, or caterpillars, 20 and 21 are mounted to present opposed drive runs 22 and 23 spaced to engage and propel the workpiece into and through the sequentially disposed guide 15 and die 11. The belts are activated by a pair of drive wheels 24 and 25 which may be powered by a suitable motor 26 interconnected by a power train 28. A pair of idler rolls 29 and 30 are spaced from the drive wheels to define drive runs 22 and 23 that are of sufficient span to minimize slippage between the belts 20 and 21 in the workpiece 14. The idler rolls 29 and 30 may, if desired, be of relatively lesser diameter than schematically represented in FIG. 1 in order to permit the guide to be brought into closer proximity to the point where the caterpillars 20 and 21 disengage from their contact with the workpiece 14—thus decreasing the unsupported span of the workpiece. Compatable with employing an idler roll of minimal radius, one may also employ a so called "silent chain" for the caterpillars because of the minimal radius about which such a mechanism can effectively operate. If necessary, intermediate pressure rollers 31 may be employed to enhance the engagement of the belts with the workpiece.

As is perhaps best seen in FIG. 2, the die 11 has a body portion 35 and a head 38 which intersect to form a shoulder 39. A bore 36 is provided through the stanchion 12 to receive the body portion 35 and thereby permit the die 11 to be mounted in the stanchion 12 such that the shoulder 39 engages the stanchion 12 to provide a means by which to maintain the die 11 rigidly fixed against the force applied to the die 11 by the workpiece 14 as the caterpillars 20 and 21 drive the workpiece 14 into, and through, the die 11, all as hereinafter more fully explained.

A throat 40 extends through the body portion 35 of the die parallel to the longitudinal axis 16 thereof. The cross-sectional configuration of the throat 40 conforms to the outer surface 41 of the shaped workpiece, or dowel, 14A. As depicted in FIGS. 1–5, the workpiece 14 has a rectilinear, and preferably square, configuration, prior to being shaped, and the particular die 11 is designed to shape the workpiece into a cylindrical, or dowel, configuration 14A.

As such, the cylindrical throat 40 opens through a crenelated mouth 45 having a configuration particularly suited for shaping a dowel 14A form a rectilinear workpiece 14. Specifically, the mouth 40 presents a pair of opposed noses 46 and 48 which constitute the longitudinally distal extent of the mouth 45 with respect to the body portion 35 of the die 11. A pair of cheeks extend rearwardly from each nose, and each cheek intersects with the throat to define a cutting edge at that intersection. As such, cutting edges 50 and 51 extend rearwardly from nose 46 and are formed, respectively, by the intersection of cheeks 52 and 53 with the throat 40. Similarly, cutting edges 54 and 55 extend rearwardly from nose 48 and are formed, respectively, by the intersection of cheeks 56 and 57 with the throat 40. Cutting edges 50 and 54 converge to form crotch 59 which also delineates the convergence of the cheeks 52 and 56, and cutting edges 51 and 55 converge to form crotch 60 which similarly delineates the convergence of cheeks 53 and 58.

The noses 46 and 48 thus define the longitudinally distal extent of the mouth 45 with respect to the body 35, and the crotches 59 and 60 conversely define the longitudinally proximal extent of the mouth 45 with respect to the body 35 and the die 11.

As can, perhaps, best be seen in FIG. 3, the cutting edges 50 and 51 are disposed to define an entering angle $\theta$. The entering angle $\theta$ is depicted as being approximately 32° which falls within what has been found to constitute the preferable range of from approximately 25° to 50° with respect to the longitudinal axis 16. Experimentation has revealed that employing an entering angle $\theta$ of between 25° to 50° not only provides a smooth, tear-free cut but perhaps even more importantly precludes chatter of the material, particularly as to the deeper cuts.

Similarly, too, when effecting deeper cuts it becomes desirable to provide an angle of inclination to the cheeks. With shallow cuts the cheeks can be disposed perpendicularly to the surface being formed—i.e., at a zero angle of inclination—and the entering angle itself will produce a smooth, tear-free incision without chatter. However, when one is required to remove considerable material to form a finished surface, even a larger than normal entering angle may not obviate chatter. In such a situation the cheek should also be inclined. As can best be seen in FIG. 3, the cheeks 52 and 53 are inclined rearwardly from two corresponding cutting edges 50 and 51 at an angle of at least approximately 5° with respect to a radial reference. As one views FIG. 3 the radial reference would extend directly outwardly from the cutting edge so that the degree to which one can see the cheeks 52 and 53 is in measure of the degree to which they are rearwardly inclined. Hence, the inclination is depicted between the outermost edge of the cheek and the appropriate cutting edge and is marked with the reference $\Phi$.

Of equal importance to the shape of the mouth 45 is the orientation of the workpiece 14 as it is engaged by the mouth 45. As best seen in FIG. 5, the workpiece 14 has a layered grain—represented by a plurality of lines 70—which lie parallel to the opposed faces 71 and 72 of the workpiece 14. The noses 46 and 48 engage the workpiece transversely of the grain lines 70, and as a result of the relative disposition of the noses and their interaction with the rapidly moving work piece, the noses compressively engage the opposed surfaces 71 and 72 of the workpiece—which is necessary to effect the shaping action without delayering, or destroying, the workpiece. It is not only economical, but it also enhances the operation of the die if the noses 46 and 48 are required to accomplish only a minimal removal of material from the workpiece. As the various cutting edges 50, 51, 54 and 55 converge to form the crotches 59 and 60 they effect progressively greater and then progressively lesser removal of material. As such, the crotch need not, therefore, absolutely effect the deepest cut so long as the opposed noses are positioned to apply initial compression transversely the grain of the workpiece.

Some experimentation may be required to determine the amount of compression that will result from the interaction between a die of given shape and the workpiece as it moves through the die at a given speed. In that respect it must be explained that in making a cylindrical dowel rod the throat 40 is not necessarily absolute cylinder. Because of the compression it actually proved necessary to construct the throat as an oblate cylinder with the minor axis, which extends between the noses 46 and 48, being a few thousandths of an inch (a few 0.0254 mm.) less than the major axis, which extends between the crotches 59 and 60, in order to achieve emergence of a cylindrical dowel rod 14A out of the die 11 as the workpiece was fed into the die at a rate of approximately 400 lineal feet per minute.

By employing prior art shaping means the workpiece can be processed at a maximum rate of up to perhaps 200 lineal feet per minute. The present invention has been satisfactorily tested at 400 lineal feet per minute and that appears limited only by the prime mover available to power the drive belts 20 and 21 and the present capacity for dissipating the heat generated as the workpiece is forced through the die. At 400 lineal feet per minute it was noted that the heat apparently caused the lignin in the fiberboard to flow. As such, the finished product has a relatively smooth, outer surface 41.

In addition to being a much faster means for shaping a workpiece, it was also noted that the noise level was considerably reduced from that produced when a rotary shaping head is employed. Another positive advantage is that much less dust is created in the work area—the waste simply peels off the workpiece without producing the abundance of dust heretofore experienced with rotary head shapers.

So long as one carefully designs the die to receive the workpiece in such a way that compression is applied transversely the grain, or layering, of the workpiece, rather intricate configurations can be shaped pursuant to the concept of the present invention. Wood, of course, has a natural grain, but close inspection will reveal that fiberboard also has a "grain". That is, the fibers from which the fiberboard is made are deposited layer upon layer in combination with the binder to be employed and then compressed during the manufacturing process to form the finished sheets of preselect thickness. This layering also constitutes, in effect, a grain, and the success of the present invention absolutely requires that proper orientation of that grain in conjunction with the configuration of the die mouth be observed for successful shaping operations. If either parameter is ignored, the workpiece cannot properly be shaped.

Figure 6:
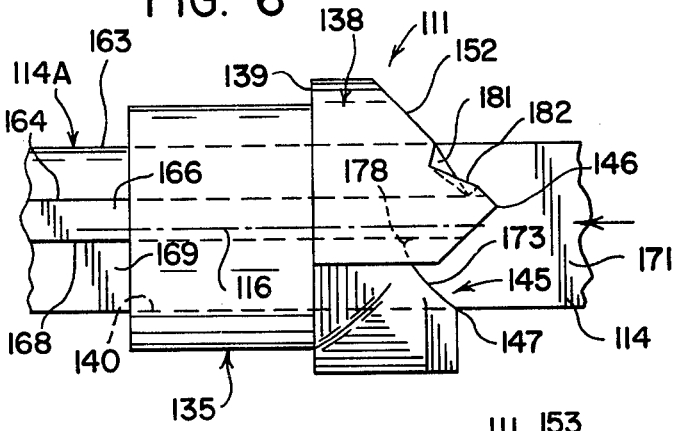
FIG. 6 is a side elevation of another exemplary embodiment of a die which embodies the concept of the present invention—depicted in the process of shaping a workpiece of generally rectangular cross-section into a molding of more intricate cross-section.
Figure 7:
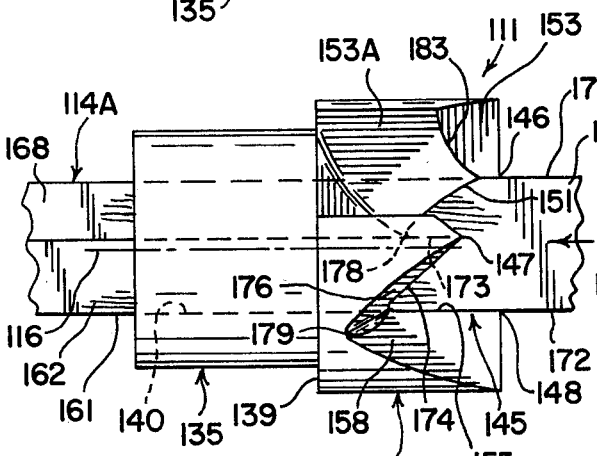
FIG. 7 is a top plan view of the die and workpiece depicted in FIG. 6; and, FIG. 8 is a frontal elevation of the die depicted in FIGS. 6 and 7 with that portion of the workpiece entering the die depicted in phantom so as not to obscure the mouth of the die.
Figure 8:
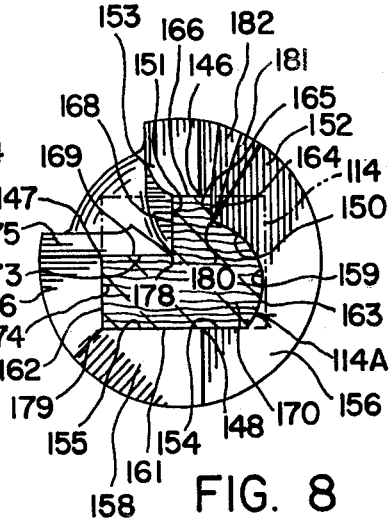

FIGS. 6–8 depict the application of these basic parameters to shape the more intricate molding 114A from the rectangular workpiece 114. The die 111 also has a body portion 135 and a head portion 138 which intersect to form a shoulder 139 that facilitates mounting the die 111 in conjunction, for example, with apparatus 10.

A throat 140 extends through the body portion 135 of the die 111 parallel to the longitudinal axis 116 thereof. The cross-sectional configuration of the throat 140 conforms to the complex outer surface of the molding 114A. The workpiece 114 had a rectilinear configuration prior to being shaped, and the die engages the workpiece in conformity with the requisite design parameters.

The shaped workpiece, or molding, 114A has a planar base 161. A planar sidewall 162 extends perpendicularly from the base. The opposite sidewall constitutes an ovolo 163 which extends arcuately from the base 161 to the edge 164 of a raised capital 165, the upper surface 166 of which lies parallel to the base 161. The planar edge 168 of the capital 165 opposite to edge 164 extends to a level lower than the intersection of the ovolo 163 to the capital edge 164 to engage a return 169 from the sidewall 162. The return 169 also parallels the base 161 and upper surface 166 of the capital. The grain lines 170 of the workpiece 114 lie parallel to the opposed faces 171 and 172 of the workpiece 114.

The throat 140, which conforms to the cross-sectional configuration of the molding 114A, opens through a crenelated mouth 145. The mouth 145 presents a pair of opposed, primary noses 146 and 148 and a secondary nose 147 to form the longitudinally distal extent of the mouth 145 with respect to the body portion 135 of the die 111. In order to comport with the basic requisite of the invention, the noses 146 and 148 are disposed to engage the opposed faces 171 and 172, respectively, of the workpiece 114. This disposition applies the obligatory transverse compression to the workpiece inasmuch as the grain, or layering, 170 of the workpiece 114 is disposed parallel to the surfaces 171 and 172.

The second requisite of the present invention is achieved by presenting a workpiece of such dimension that two surfaces of the molding 114A can be fashioned from the opposed surfaces 171 and 172 of the workpiece 114 with a minimal depth of cut. The molding 114A affords the opportunity to fashion the base 161 from surface 172 and the upper surface 166 of the capital 165 from the surface 171 with minimal cutting—if the thickness of the workpiece 114 is properly selected, or preliminarily cut.

The transverse compression may be further enhanced by having the secondary nose 147 positioned to apply supplemental compressive pressure in opposition to nose 148.

The nose 146 engages the surface 171 of the workpiece 114 at which will become the medial portion of the upper surface 166 on the capital 165. Generally in opposition thereto the nose 148 will engage the surface 172 of the workpiece 114 at which will become the medial portion of the base 161 of the finished molding 114A.

Cutting edges 150 and 151 extend rearwardly from the nose 146 and are formed, respectively, by the intersections of the cheeks 152 and 153 with the throat 140. Similarly, cutting edges 154 and 155 extend rearwardly from nose 148 and are formed, respectively, by the intersections of cheeks 156 and 158 with the throat 140. The cutting edges 150 and 154 converge to form a crotch 159 at approximately the widest portion of the ovolo 163.

Cutting edges 173 and 174 extend rearwardly from the nose 147 and are formed, respectively, by the intersection of the cheeks 175 and 176 with the throat 140. Cutting edge 173 intersects cutting 151 to form crotch 178, and cutting edge 174 intersects cutting edge 155 to form crotch 179.

Cutting edge 154 is disposed to define an entering angle of approximately 37° and shapes the minor portion of the base 161 and one half of the ovolo 163. At that point it terminates in crotch 159 which is formed in conjunction with cutting edge 154 as it intersects cutting edge 150. Cutting edge 150 is disposed to define an entering angle of approximately 44° and shapes the remainder of the ovolo 163 as well as one edge 164 and approximately one half the upper surface 166 of the capital 165.

In order to assure a clean, sharply defined incision at the intersection 180 of the ovolo 163 and the edge 164 of the capital 165 it is desirable to at least maintain, and perhaps emphasize, the entering angle of the cutting edge 150 as it shapes that particular intersection. It should be appreciated that the entering angle is in relation to the plane of the surface being cut. As such, to maintain a satisfactory entering angle between a series of successive surfaces—formed over sufficiently short distance that the cutting edge to shape those surfaces is formed by the intersection of a common cheek with the throat—that are inclined one with respect to the other, and particularly in the situation, as here, where the surfaces are at right angles to each other, some accomodation must be made to assure the desired entering angle. This result can be accomplished by recessing the appropriate cheek 152 with a v-shaped notch defined by adjacent wingwalls 181 and 182 which extend from the intersection 180 outwardly along the face of cheek 152. By extending the wingwalls 181 and 182 all the way to the throat 140, they effect the desired entering angle to the disposition of the cutting edge 150 along that portion thereof which shapes the surfaces of the molding which meet at intersection 180.

Cutting edge 151 is disposed to define an entering angle of approximately 40° as it shapes the remainder of the upper surface 166 on capital 165. To provide the approximately 32° entering angle of the cutting edge 150 as it shapes the edge 168 of the capital 165, the cheek 153 breaks, as at 183, to form a flank 153A which will intersect the throat 178 to provide the desired disposition to that portion of the cutting edge 150.

Cutting edge 173 extends from the secondary nose 147 directly to crotch 178 at an entering angle of approximately 46° to shape the single surface which constitutes the return 169. Similarly, cutting edge 174 extends from the secondary nose 147 directly to crotch 179 at an entering angle of approximately 41° to shape the single surface which constitutes the planar sidewall 172.

To complete the description of the plurality of cutting edges presented by crenelated mouth 145, cutting edge 155 extends from nose 148 directly to crotch 179 at an entering angle of approximately 42° to shape the remainder of the planar base 161.

It should now be apparent the various cutting edges employed to shape the molding 114A are each disposed to provide an entering angle $\theta$ that falls within the preferred 25° to 50° range. In addition, the cheeks which form each cutting edge are inclined rearwardly from the cutting edge at an angle Φ of no less than approximately 5° with respect to a reference line, or ray, which extends through the cutting edge perpendicularly to the shaped surface. Even the more intricate molding configuration 114A can be shaped through a die 111 in apparatus 10 at lineal speeds of at least 400 feet per minute if the grain of the workpiece is properly oriented.

As such, the present invention provides a unique die, apparatus and method for shaping a workpiece that is driven, at relatively high speeds, through a fixed die and otherwise accomplishes the stated objects.

I claim:

1. A method for shaping a desired, finished cross-section of a workpiece having a layered structure comprising the steps of: selecting a workpiece of sufficient cross-sectional area to provide the finished cross-section, orienting the workpiece so that the layered structure thereof is oriented in a predetermined disposition, driving the workpiece through an aligning guide and into a die having a mouth, providing a plurality of cutting surfaces on said mouth of said die such that said die initially engages the workpiece transversely said predetermined disposition of the layered structure and disposing said cutting surfaces on said mouth of the die to effect deeper cuts into the workpiece only after said die has initially engaged the workpiece transversely said predetermined disposition of the layered structure.

2. A method, as set forth in claim 1, having the additional steps of: forming a crenelated mouth having projecting noses on the die with said cutting surfaces disposed along the crenelations, locating said projecting noses of said crenelated mouth so that they opposingly engage the workpiece transversely the layered structure thereof.

3. A method, as set forth in claim 2, having the additional steps of: locating said cutting surfaces along said crenelations so that said deeper cuts into the workpiece are effected rearwardly of said noses.

* * * * *